US012035782B2

(12) United States Patent
Torrence

(10) Patent No.: US 12,035,782 B2
(45) Date of Patent: Jul. 16, 2024

(54) ADAPTABLE FOOTWEAR AND FOOTWEAR ACCESSORIES

(71) Applicant: Chassedy Monae Torrence, Saint Louis, MO (US)

(72) Inventor: Chassedy Monae Torrence, Saint Louis, MO (US)

( * ) Notice: Subject to any disclaimer, the term of this patent is extended or adjusted under 35 U.S.C. 154(b) by 0 days.

(21) Appl. No.: 17/124,010

(22) Filed: Dec. 16, 2020

(65) Prior Publication Data

US 2021/0219652 A1 Jul. 22, 2021

Related U.S. Application Data

(60) Provisional application No. 62/974,620, filed on Dec. 16, 2019.

(51) Int. Cl.

| | |
|---|---|
| ***A43B 3/24*** | (2006.01) |
| ***A43B 3/12*** | (2006.01) |
| ***A43B 23/24*** | (2006.01) |

(52) U.S. Cl.

CPC ..... *A43B 3/242* (2013.01); *A43B 3/122* (2013.01); *A43B 23/24* (2013.01)

(58) Field of Classification Search

CPC ..... A43B 23/24; A43B 23/242; A43B 23/122
USPC ..... 36/100, 101
See application file for complete search history.

(56) References Cited

U.S. PATENT DOCUMENTS

| | | | | |
|---|---|---|---|---|
| 3,032,896 | A * | 5/1962 | Weaver | A43B 1/0027 36/101 |
| 6,651,359 | B1 * | 11/2003 | Bricker | A43B 3/24 36/11.5 |
| 6,769,204 | B1 * | 8/2004 | Phillips | A43B 3/0078 36/11.5 |
| 7,272,899 | B1 * | 9/2007 | Marak | A43B 3/122 36/11.5 |
| 2004/0093765 | A1 * | 5/2004 | Baldwin | A43D 999/00 36/11.5 |
| 2005/0066550 | A1 * | 3/2005 | Liu | A43B 1/0081 36/11.5 |
| 2007/0094897 | A1 * | 5/2007 | Nakatsu | A43B 1/0054 36/100 |
| 2008/0028636 | A1 * | 2/2008 | Lusk | A43B 3/0078 36/11.5 |
| 2010/0186258 | A1 * | 7/2010 | Garza | A43B 23/24 36/11.5 |

* cited by examiner

*Primary Examiner* — Ted Kavanaugh
(74) *Attorney, Agent, or Firm* — Eversheds Sutherland (US) LLP

(57) ABSTRACT

Wearable devices and accessories are described herein. A wearable device may include a first portion configured to support at least a portion of a person's foot. The wearable device may include a second portion on a first side of the wearable device and configured to attach to and detach from a detachable device. The wearable device may include a third portion on a second side of the wearable device and configured to attach to and detach from the detachable device. The detachable device may span from the first portion to the second portion when attached to the wearable device.

18 Claims, 4 Drawing Sheets

ADAPTABLE FOOTWEAR AND FOOTWEAR ACCESSORIES

CROSS-REFERENCE TO RELATED APPLICATION(S)

This application claims the benefit of U.S. Provisional Application No. 62/974,620, filed Dec. 16, 2019, the disclosure of which is incorporated by reference as if set forth in full.

TECHNICAL FIELD

This disclosure relates to footwear and footwear accessories.

BACKGROUND

People increasingly want more clothing options. However, it is not desirable to have to own too many clothes or have to change clothes throughout the day. In particular, it may be desirable for people to wear different footwear during a single day based on activities, weather, and the like. However, it is not always desirable for people to have to change shoes throughout the day. There is therefore a need for adaptable footwear.

Figure 1:
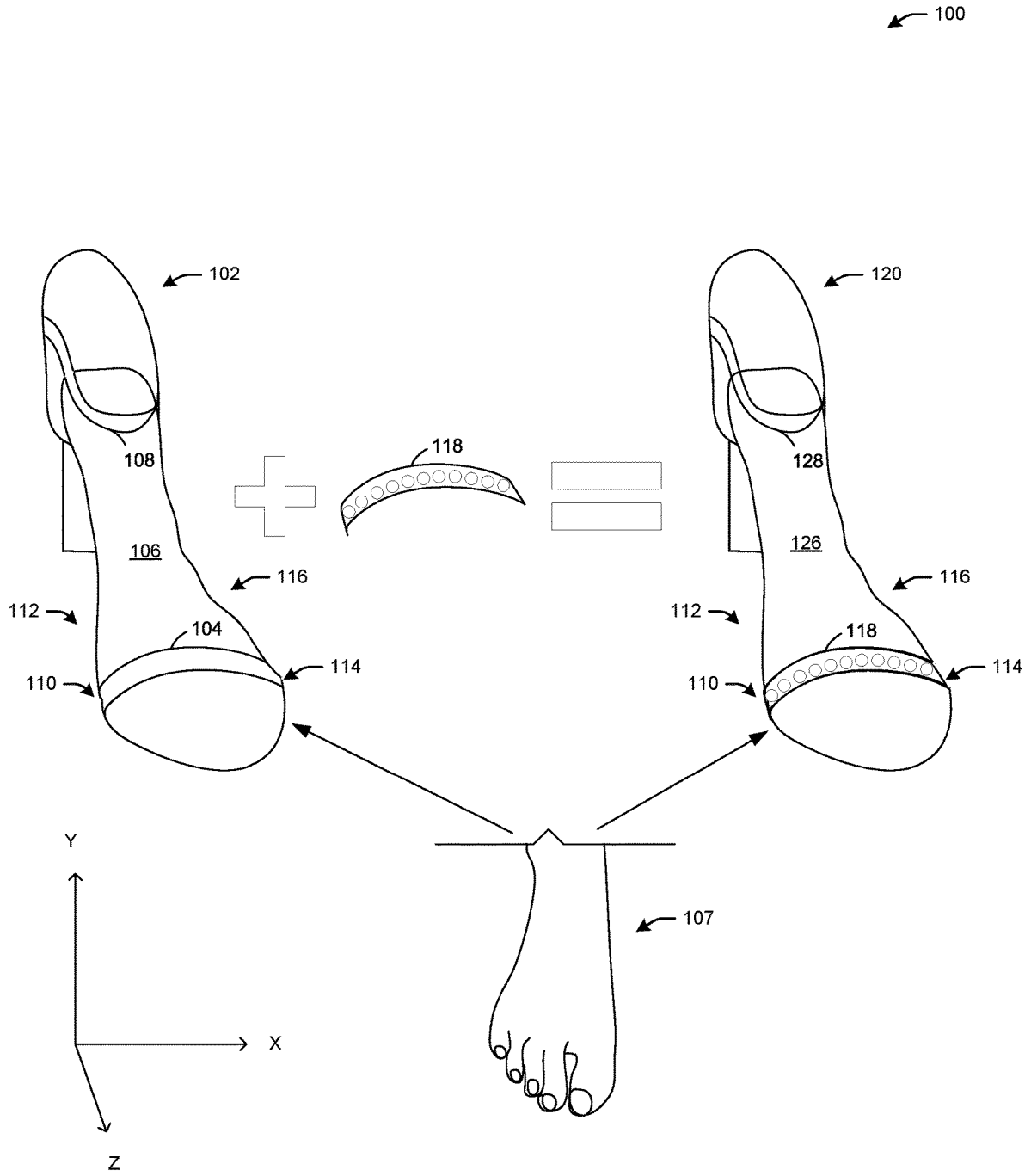
FIG. 1 illustrates adaptable footwear and footwear accessories, in accordance with one or more example embodiments of the present disclosure.

Certain implementations will now be described more fully below with reference to the accompanying drawings, in which various implementations and/or aspects are shown. However, various aspects may be implemented in many different forms and should not be construed as limited to the implementations set forth herein; rather, these implementations are provided so that this disclosure will be thorough and complete, and will fully convey the scope of the disclosure to those skilled in the art. Like numbers in the figures refer to like elements throughout. Hence, if a feature is used across several drawings, the number used to identify the feature in the drawing where the feature first appeared will be used in later drawings.

DETAILED DESCRIPTION

Overview

Example embodiments described herein provide adaptable footwear and footwear accessories.

People often wear shoes, sandals, and other footwear, sometimes multiple different types and styles of footwear during a single day. For example, a person may wear one pair of shoes to work, another pair of shoes at home, and yet another pair of shoes to a social gathering. Changing footwear may require changing outfits and other accessories so that outfits, footwear, and accessories match. Also, owning multiple pairs of footwear may be expensive. Changing clothes, footwear, and accessories, and spending a lot of money of clothes, footwear, and accessories may be undesirable.

There is therefore a need for adaptive footwear and related footwear accessories.

In one or more embodiments, one pair of shoes or other footwear effectively may transform into multiple pairs of shoes or other footwear by allowing for portions of the shoes (e.g., accessories) to be detachable and replaceable. In particular, shoes that include one or more straps to secure a person's foot may allow for the straps to detach so that different colors and styles of straps may be added to or detached from the shoes. A person may wear a single pair of shoes with one set of detachable straps for work, another set of straps while at home, and another set of straps for a party, for example, effectively allowing the person to wear different looking shoes without actually requiring multiple pairs of shoes.

In one or more embodiments, to allow for detachable accessories for shoes that are secure to the shoes when attached, the shoes and/or accessories may use securing mechanisms (e.g., devices) such as buttons, hooks, clasps, adhesives, ties (e.g., strings, threads, etc.), or the like. The shoes may have a non-detachable strap to which a detachable strap may attach using the securing mechanisms, or the detachable strap may attach to portions of shoes without requiring a non-detachable strap. The straps or other accessories may have different colors, designs, materials, shapes, and sizes.

The above descriptions are for purposes of illustration and are not meant to be limiting. Numerous other examples, configurations, processes, etc., may exist, some of which are described in greater detail below. Example embodiments will now be described with reference to the accompanying figures.

Illustrative Processes and Use Cases

FIG. 1 illustrates adaptable footwear and footwear accessories 100, in accordance with one or more example embodiments of the present disclosure.

Referring to FIG. 1, the adaptable footwear and footwear accessories 100 may include a shoe 102 with a strap 104, a portion 106 for supporting a person's foot 107, and a strap 108. The strap 104 and/or the strap 108 may be non-detachable or at least partially detachable from the shoe 102. To change or add a design to the strap 104, for example, detachable strap 118 may attach to and detach from the shoe 102 via the strap 104, resulting in a shoe 120 having the detachable strap 118, a portion 126 to support the person's foot 107, and a strap 128 (e.g., similar to the strap 108).

The strap 104 may attach to a first portion 110 of the shoe 102 on a first side 112 of the shoe 102, and may attach to a second portion 114 of the shoe 102 on a second side 116 of the shoe 102 (e.g., the first side 112 may be further to the left along the X-axis than the second side 116). The detachable strap 118 may attach to and detach from the first portion 110 and the second portion 114 of the shoe 120 as shown (e.g., using connection mechanisms shown in FIG. 3 and FIG. 4). In this manner, attaching the detachable strap 118 to the shoe 102 may transform the shoe 102 into a different shoe (e.g., the shoe 120) based on the color, design, shape, pattern, etc. of the detachable strap 118. In this manner, the shoe 102 may become multiple shoes (e.g., to wear at different times and occasions). The straps in FIG. 1 may be referred to as devices (e.g., attachable or detachable devices, bands, etc.), and the shoes 102 and 120 may be referred to as wearable devices, and may include other styles and types of footwear, such as sandals, slippers, boots, and the like.

Figure 2:
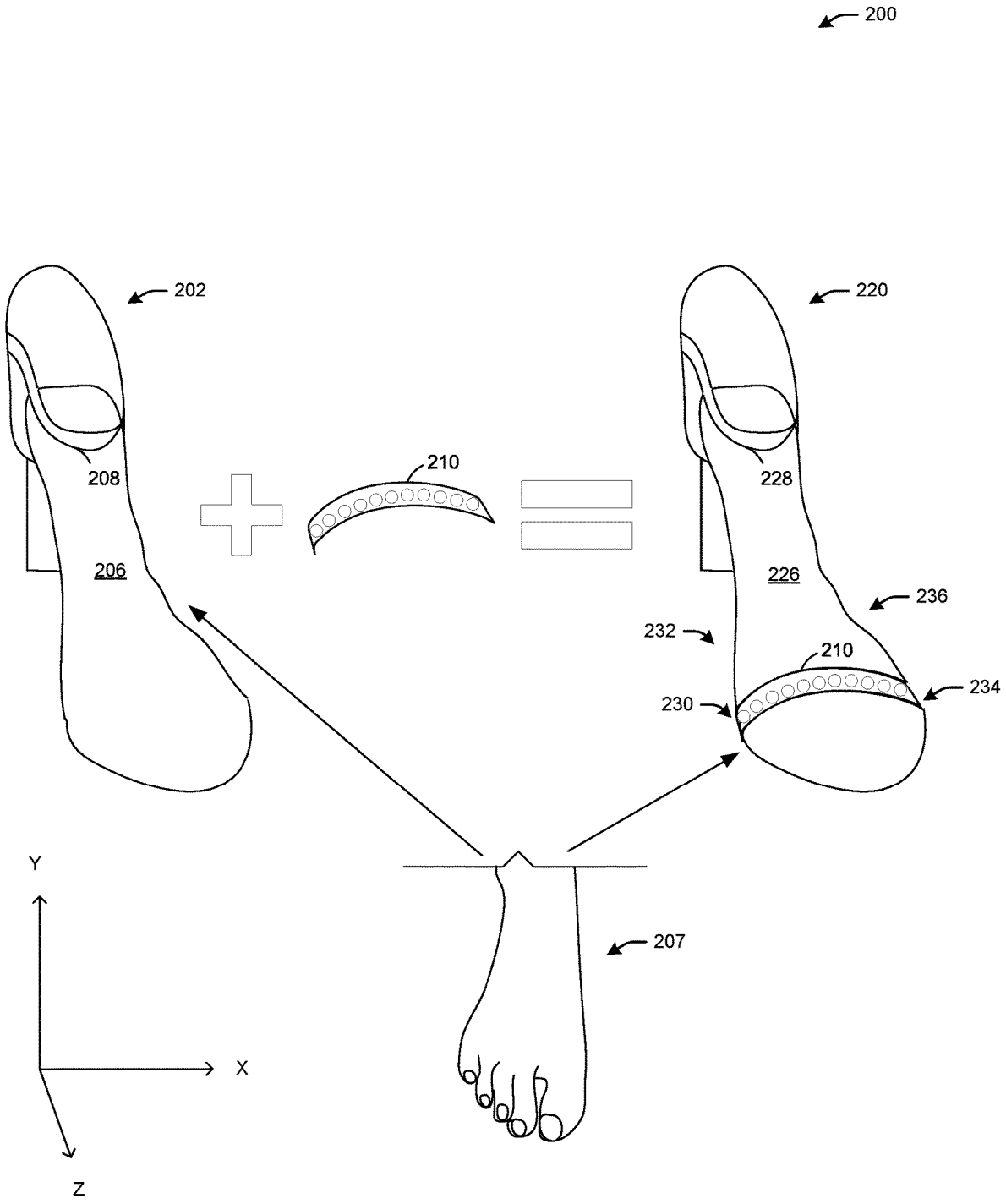
FIG. 2 illustrates adaptable footwear and footwear accessories, in accordance with one or more example embodiments of the present disclosure.

FIG. 2 illustrates adaptable footwear and footwear accessories 200, in accordance with one or more example embodiments of the present disclosure.

Referring to FIG. 2, the adaptable footwear and footwear accessories 200 may include a shoe 202 with a portion 206 for supporting a person's foot 207, and a strap 208. The strap 208 may be non-detachable or at least partially detachable from the shoe 202. Unlike the shoe 102 of FIG. 1, however, the shoe 202 shown in FIG. 2 does not include the strap 104. In this manner, a detachable strap 210 may attach to and detach from the shoe 202 whether or not the shoe 202 includes a strap such as the strap 104 of FIG. 1. Attaching the detachable strap 210 to the shoe 202 may transform the shoe 202 into a shoe 220.

The strap 210 may attach to a first portion 230 of the shoe 220 on a first side 232 of the shoe 220, and may attach to a second portion 234 of the shoe 220 on a second side 236 of the shoe 220 (e.g., the first side 232 may be further to the left along the X-axis than the second side 236). The detachable strap 210 may attach to and detach from the first portion 230 and the second portion 234 of the shoe 220 as shown (e.g., using connection mechanisms shown in FIG. 3 and FIG. 4). In this manner, attaching the detachable strap 210 to the shoe 202 may transform the shoe 202 into a different shoe (e.g., the shoe 220) based on the color, design, shape, pattern, etc. of the detachable strap 210. In this manner, the shoe 202 may become multiple shoes (e.g., to wear at different times and occasions). The straps in FIG. 2 may be referred to as devices (e.g., attachable or detachable devices, bands, etc.), and the shoes 202 and 220 may be referred to as wearable devices, and may include other styles and types of footwear, such as sandals, slippers, boots, and the like.

Figure 3:
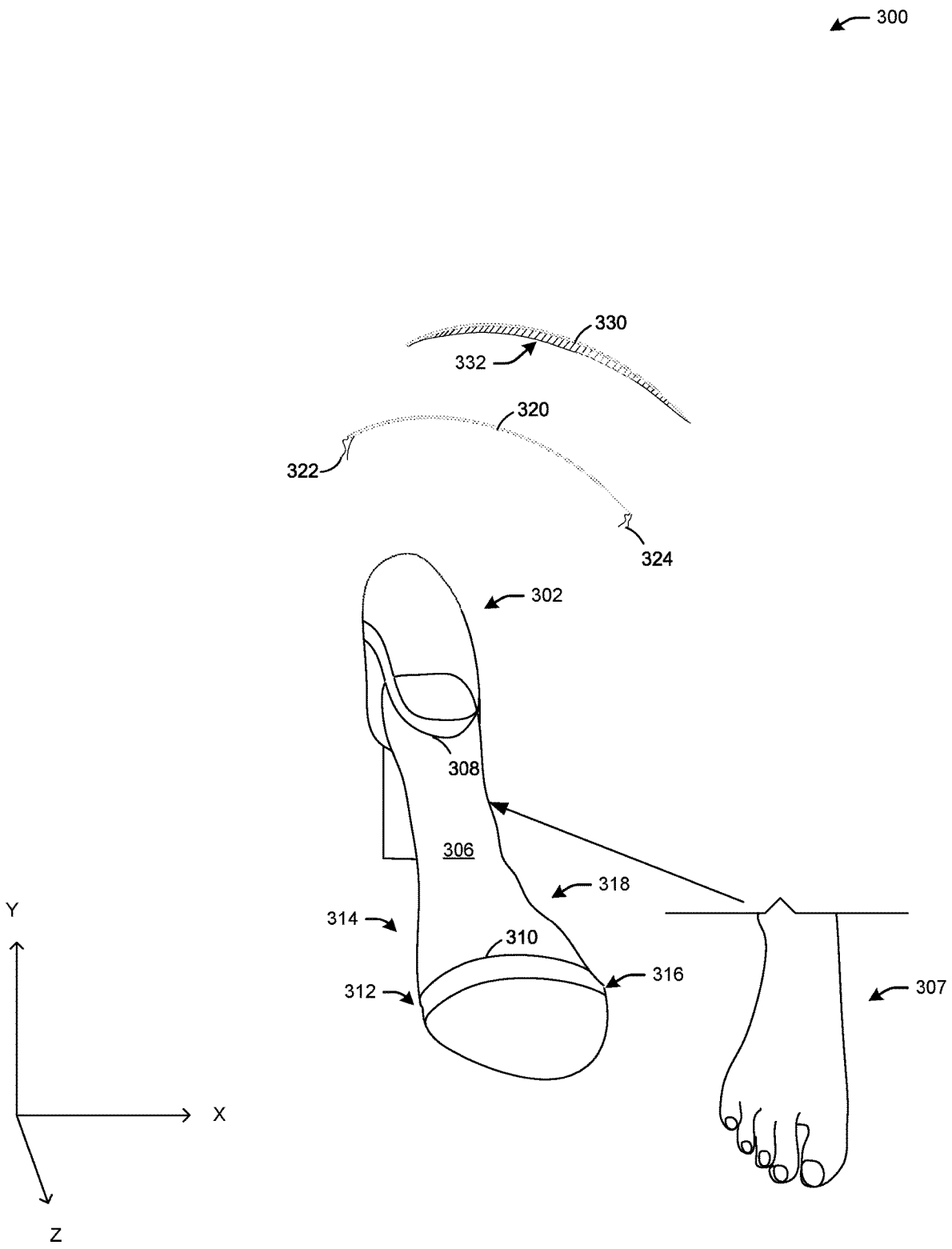
FIG. 3 illustrates adaptable footwear and footwear accessories, in accordance with one or more example embodiments of the present disclosure.

FIG. 3 illustrates adaptable footwear and footwear accessories 300, in accordance with one or more example embodiments of the present disclosure.

Referring to FIG. 3, a shoe 302 may include a portion 306 for supporting a person's foot 307 (e.g., the person's foot 307 may be positioned at least partially onto the portion 306 to support the weight of the foot 307). The shoe 302 may include a strap 308, which may be attached to and either non-detachable from or at least partially detachable from the shoe 302. The strap 308 may be positioned higher on the shoe 302 (e.g., higher along the Y-axis, perpendicular to the ground as represented by the Z-axis) than strap 310 of the shoe 302. The shoe 302 may include a first portion 312 on a first side 314 of the shoe 302, and a second portion 316 on a second side 318 of the shoe 302 (e.g., the first side 314 may be to the left of the second side 318 along the X-axis). A strap 320 or a strap 330 may attach to and detach from the first side 314 and the second side 318 (e.g., at the first portion 312 and the second portion 316).

In one or more embodiments, to attach strap 320 to the shoe 302, the strap 320 may include a first attachment mechanism 322 on one side (e.g., the first side 314) and a second attachment mechanism 324 on another side (e.g., the second side 318). The first attachment mechanism 322 and the second attachment mechanism 324 may include string, rope, thread, or another mechanism for tying or otherwise securing portions of the strap 320 to the strap 310 (e.g., attaching the strap 118 to the shoe 120 of FIG. 1 or attaching the strap 210 to the shoe 220 of FIG. 2).

In one or more embodiments, the strap 330 may attach to the strap 310 by using an adhesive material 332, such as fabric, glue, paste, and the like. The adhesive material 332 may cause the strap 310 to at least partially adhere to the strap 310, allowing for different designs for the shoe 302 to replace the strap 310. To remove the strap 330 from the strap 310, the strap 330 may be peeled from the strap 310 so that the shoe 302 may be worn with the strap 310 showing, or so that another strap (e.g., the strap 320) may attach to the strap 310 to be displayed.

In one or more embodiments, the detachable straps 320 and 330 may include any color, pattern, design, material, objects (e.g., sequins, jewels, diamonds, etc.).

In one or more embodiments, when the detachable straps 320 and 330 attach to the shoe 302, the result may look like the shoe 120 in FIG. 1 and the shoe 220 in FIG. 2.

Figure 4:
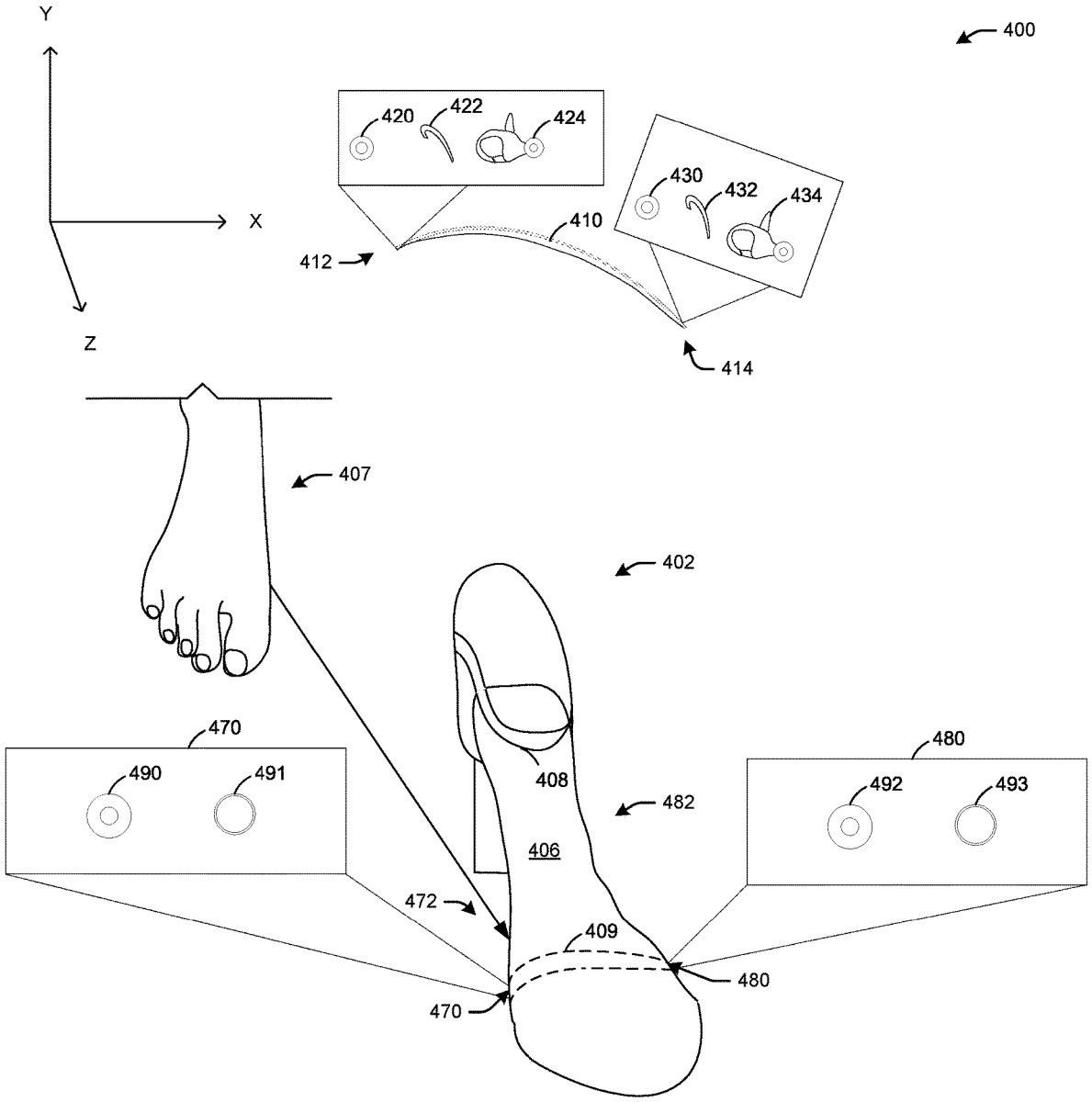
FIG. 4 illustrates adaptable footwear and footwear accessories, in accordance with one or more example embodiments of the present disclosure.

FIG. 4 illustrates adaptable footwear and footwear accessories 400, in accordance with one or more example embodiments of the present disclosure.

Referring to FIG. 4, a shoe 402 may include a first portion 406 (e.g., a sole portion) for supporting a person's foot 407 (e.g., the person's foot 407 may be positioned at least partially onto the first portion 406 to support the weight of the foot 407). The shoe 402 may include a strap 408, which may be attached to and either non-detachable from or at least partially detachable from the shoe 402. The strap 408 may be positioned higher on the shoe 402 (e.g., higher along the Y-axis, perpendicular to the ground as represented by the Z-axis) than optional strap 409 (e.g., similar to the strap 104 of FIG. 1) of the shoe 402. Using the strap 409 or without the strap 409 being present, a detachable strap 410 may have a first connection mechanism 412 and a second connection mechanism 414 (e.g., on opposite sides of the detachable strap 410) to attach the detachable strap 410 to the shoe 402.

In one or more embodiments, the first connection mechanism 412 may include a first button 420, a first hook 422, a first clasp 424, or another mechanism for allowing the detachable strap 410 to attach to or detach from the shoe 402. The second connection mechanism 414 may include a second button 430, a second hook 432, a second clasp 434, or another mechanism for allowing the detachable strap 410 to attach to or detach from the shoe 402. The first connection mechanism 412 may attach to and detach from a second portion 470 of the shoe 402 on a first side 472 of the shoe 402, and the second connection mechanism 414 may attach to and detach from a third portion 480 of the shoe 402 on a second side 482 of the shoe 402 (e.g., the first side 472 may be further to the left along the X-axis than the second side 482). In particular, the first button 420 may snap into a button 490 of the shoe 402 when the second portion 470 of the shoe 402 includes the button 490. When the first connection mechanism 412 includes the first hook 422 and the second portion 470 of the shoe 402 includes a ring 491 (e.g., loop), the first hook 422 may operatively connect to the ring 491 to secure the detachable strap 410 to and detach the detachable strap 410 from the shoe 402. When the first connection mechanism 412 includes the first clasp 424 and the second portion 470 of the shoe 402 includes the ring 491, the first clasp 424 may operatively connect the detachable strap 410 to and detach the detachable strap 410 from the shoe 402. Similarly, when the second connection mechanism 414 includes the second button 430 and the third portion 480 of the shoe 402 includes a second button 492, the second button 430 may operatively connect the detachable strap 410 to and detach the detachable strap 410 from the shoe 402. When the second connection mechanism 414 includes the second hook 432 and the third portion 480 of the shoe 402 includes a second ring 493 (e.g., loop), the second hook 432 may operatively connect the detachable strap 410 to and detach the detachable strap 410 from the shoe 402. When the second connection mechanism 414 includes the second clasp 434 and the third portion 480 of the shoe 402 includes the second ring 493, the second clasp 434 may operatively connect the detachable strap 410 to and detach the detachable strap 410 from the shoe 402.

In one or more embodiments, when the detachable strap 410 attach to the shoe 402, the result may look like the shoe 120 in FIG. 1 and the shoe 220 in FIG. 2.

Referring to FIGS. 1-4, while one shoe is shown per figure (e.g., for a person's right foot), any embodiment shown may be applied to another shoe (e.g., a left foot shoe) or other types and sizes of footwear. Also referring to FIGS. 1-4, the detachable straps shown span from the left side to the right side of the shoe, although other implementations may allow for detachable straps (e.g., bands) to span one or portions between the left and right sides of shoes (e.g., only partially covering non-detachable shoe straps). While a particular type/style of shoe is shown in the figures, other styles/types of shoes may implement the attachment to and detachment from detachable straps (e.g., shoes with high heels, shoes without high heels, shoes with wedges, shoes that cover a person's toes, shoes that leave a person's toes exposed, etc.). The locations where the detachable straps attach to the shoes may be within the shoes (e.g., in the example shown in FIG. 2, because there is no strap to which to attach the detachable strap 210, the first portion 230 and the second portion 234 to which the detachable strap may attach may be on, within—such as with an insert into the portion 226 of the shoe, or under the surface represented by the portion 226 onto which a person's foot may be placed within the shoe 220).

Also referring to FIGS. 1-4, the detachable bands are shown as attaching to the lower portion of the shoes proximal to where a person's toes might be when wearing the shoes. However, the detachable straps may attach to another portion of the shoes, such as to strap 128 in FIG. 1, to strap 228 of FIG. 2, to strap 308 of FIG. 3, or to strap 408 of FIG. 4 (e.g., using any of the connection mechanisms shown in FIGS. 3 and 4). In this manner, one or multiple detachable straps may attach to and detach from any shoe, and the portions to which the connection mechanisms of FIGS. 3 and 4 connect to the shoes may be found at any location on or in a shoe. While the connection mechanisms shown are examples, they are not an exclusive list of connection mechanisms. For example, the straps may insert into the shoe, may use a clamping mechanism, a latching mechanism, or the like. For example, instead of the first clasp 424 or the second clasp 434 of FIG. 4, the connection mechanism may include a clamping mechanism, such as with spring tension to secure and unsecure the straps from the shoe.

The examples presented are not meant to be limiting.

Embodiments according to the disclosure are in particular disclosed in the attached claims directed to footwear and footwear accessories, wherein any feature mentioned in one claim category, e.g., method, can be claimed in another claim category as well. The dependencies or references back in the attached claims are chosen for formal reasons only. However, any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

The foregoing description of one or more implementations provides illustration and description, but is not intended to be exhaustive or to limit the scope of embodiments to the precise form disclosed. Modifications and variations are possible in light of the above teachings or may be acquired from practice of various embodiments.

The processes described and shown above may be carried out or performed in any suitable order as desired in various implementations. Additionally, in certain implementations, at least a portion of the processes may be carried out in parallel, creating a co-existence use case. Furthermore, in certain implementations, less than or more than the processes described may be performed.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims.

The invention claimed is:

1. A wearable device comprising:

a first portion comprising a sole configured to support at least a portion of a person's foot, the sole comprising a second portion on a first side of the sole and a third portion on a second side of the sole, wherein a first securing device is on an exterior of the second portion, and wherein a second securing device is on an exterior of the third portion;

a detachable device spanning from the second portion to the third portion when attached to the sole; and a fourth portion spanning from the second portion to the third portion, wherein the fourth portion is non-detachable from the wearable device, and wherein the detachable device is configured to attach to and detach from the exterior of the second portion using the first securing device and the exterior of the third portion using the second securing device.

2. The wearable device of claim 1, wherein the fourth portion is non-detachable from at least one of the second portion or the third portion.

3. The wearable device of claim 1, wherein the fourth portion is at least partially above the second portion.

4. The wearable device of claim 1, wherein the first securing device comprises a first button and the second securing device comprises a second button.

5. The wearable device of claim 1, wherein the first securing device comprises a first hook and the second securing device comprises a second hook.

6. The wearable device of claim 1, wherein the first securing device comprises a first clasp and the second securing device comprises a second clasp.

7. The wearable device of claim 1, wherein the first securing device comprises a first thread and the second securing device comprises a second thread.

8. The wearable device of claim 1, wherein the fourth portion is configured to attach to and detach from the detachable device using the second portion and the third portion.

9. The wearable device of claim 8, wherein the fourth portion is configured to attach to detach from the detachable device using an adhesive material.

10. A shoe comprising:

a first portion comprising a sole configured to support at least a portion of a person's foot, the sole comprising a second portion on a first side of the sole and a third portion on a second side of the sole, wherein a first securing device is on an exterior of the second portion, and wherein a second securing device is on an exterior of the third portion; and a strap configured to attach to and detach from the exterior of the second portion on the first side of the sole using the first securing device and the exterior of the third portion on the second side of the sole using the second securing device; and a non-detachable strap spanning between the first side and the second side, wherein the strap spans between the second portion on the first side of the sole and the third portion on the second side of the sole.

11. The shoe of claim 10, wherein the first securing device comprises a first button and the second securing device comprises a second button.

12. The shoe of claim 10, wherein the first securing device comprises a first hook and the second securing device comprises a second hook.

13. The shoe of claim 10, wherein the first securing device comprises a first clasp and the second securing device comprises a second clasp.

14. The shoe of claim 10, wherein the first securing device comprises a first thread and the second securing device comprises a second thread.

15. The shoe of claim 10, wherein the strap is configured to attach to the second portion on the first side of the sole and the third portion on the second side of the sole using an adhesive material.

16. A wearable device comprising:

a first portion comprising a sole configured to support at least a portion of a person's foot, the sole comprising a second portion on a first side of the sole and a third portion on a second side of the sole, wherein a first securing device is on an exterior of the second portion, and wherein a second securing device is on an exterior of the third portion;

a detachable strap configured to attach to and detach from the exterior of the second portion on the first side of the sole using the first securing device and the exterior of the third portion on the second side of the sole using the second securing device; and a non-detachable strap spanning from the first side to the second side; and wherein the detachable strap spans from the second portion on the first side of the sole to the third portion on the second side of the sole when attached to the sole.

17. The wearable device of claim 16, wherein the first securing device and the second securing device comprise at least one of buttons, hooks, clasps, or threads.

18. The wearable device of claim 16, wherein the non-detachable strap is at least partially above the second portion.

* * * * *